US005393381A

United States Patent [19]

Hund et al.

[11] Patent Number: 5,393,381

[45] Date of Patent: Feb. 28, 1995

[54] PROCESS FOR THE MANUFACTURE OF A PAPER OR A CARDBOARD HAVING IMPROVED RETENTION

[75] Inventors: René Hund, Villars; Eric Philibert, Saint Etienne, both of France

[73] Assignee: S N F, France

[21] Appl. No.: 74,026

[22] Filed: Jun. 2, 1993

[30] Foreign Application Priority Data

Jun. 11, 1992 [FR] France ..... 92 07308

[51] Int. Cl.[6] ..... D21H 17/45

[52] U.S. Cl. ..... 162/168.3; 162/181.6; 162/181.8; 162/183

[58] Field of Search ..... 162/168.2, 168.3, 181.6, 162/183, 181.8

[56] References Cited

U.S. PATENT DOCUMENTS 2,368,635 2/1945 Booth .
3,052,595 9/1962 Pye .
4,305,781 12/1981 Langley et al. .
4,749,444 6/1988 Lorz et al. ..... 162/168.3
5,126,014 6/1992 Chung ..... 162/168.2
5,178,730 1/1993 Bixler et al. ..... 162/168.3

FOREIGN PATENT DOCUMENTS 0017353 10/1980 European Pat. Off. .
0235893 1/1987 European Pat. Off. .
0374458 11/1989 European Pat. Off. .
2283102 3/1976 France .
2262906 10/1973 Germany .

*Primary Examiner*—Peter Chin
*Attorney, Agent, or Firm*—Harris Beach & Wilcox

[57] ABSTRACT

Process for the manufacture of a paper or a cardboard having improved retention, in which a polyacrylamide and bentonite are added to the fibrous suspension, wherein in that the polyacrylamide is a branched polyacrylamide, which is easily soluble in water, and is introduced in the dissolved powder form at a concentration of 0.03 to 1.0 per thousand (0.03 to 1.0%) by weight of the dry weight of the fibrous suspension.

4 Claims, No Drawings

PROCESS FOR THE MANUFACTURE OF A PAPER OR A CARDBOARD HAVING IMPROVED RETENTION

The invention relates to a process for the manufacture of a paper or a cardboard having improved retention.

BACKGROUND OF THE INVENTION

During the manufacture of paper, cardboard or similar, it is well known to introduce, into the pulp, retention agents whose function is to retain the maximum amount of fines and of fillers in the sheet. The beneficial effects which follow from the use of a retention agent are essentially:

- increase in production and reduction in manufacturing costs: energy saving, more regular operation of machinery, higher yield of fibres, fines, fillers and anionic ennobling products, lower acidity in the circuit linked to a decrease in the use of aluminium sulphate and thus lessening of corrosion problems;
- improvement in quality: better formation and look through; improvement in the moisture content on the sheet, of the opacity, of the smoothness and of the absorbency and decrease in the porosity of the paper.

It has long been proposed to add bentonite to the pulp, it being possible for the bentonite to be optionally added to other inorganic products, such as aluminium sulphates, or even synthetic polymers, especially polyethyleneimine (see, for example, documents DE-A-2,262,906 and U.S. Pat. No. 2,368,635).

In the document U.S. Pat. No. 3,052,595, it has been proposed to combine bentonite with a linear polyacrylamide. This process has not really been developed, because it has been competing with systems which are easier to implement while being just as effective. Additionally, even with current linear polyacrylamides, the retention power is still insufficient.

In the document EP-A-0,017,353, it has been proposed, for the retention of pulps containing only a small amount of fillers (at most 5% of fillers), to combine the bentonite with a weakly anionic, nonionic linear copolyacrylamide. This process has not really been developed, because these polymers have relatively little activity as regards retention, especially of pulps containing fillers, no doubt as a result of insufficient synergy between these copolymers and the bentonite which has little tendency to recoagulate.

In the document EP-A-0,235,893, it has been proposed to resort to essentially linear, or even partially crosslinked, cationic polyacrylamides having a molecular weight greater than one million, preferably thirty millions and more. In that way, an admittedly satisfactory retention effect is obtained, but still judged insufficient in the papermaking application, because, use of bentonite resulting in water treatment difficulties, users only select this system in the event of significant advantages.

In the article by TAPPI, published in Abstracts Bulletin of the Institute of Paper Science and Technology (vol. 62, No. 10, April 1992, page 1165), a mechanism of the supercoagulation of activated bentonite in the presence of a cationic copolyacrylamide was described, without the exact nature of it being specified. This process has the same disadvantages as previously.

The invention overcomes these disadvantages.

SUMMARY OF THE INVENTION

It aims at an improved process of the type in question, which consists in adding a polyacrylamide and bentonite to the fibrous suspension and which makes it possible to obtain a markedly improved retention of fines and of fillers without reverse effect.

This improvement is characterised in that the polyacrylamide is branched and is easily soluble in water, and is introduced into the suspension in the dissolved powder form at a concentration of 0.03 to one per thousand (0.03 to 1%) by weight of the dry weight of the fibrous suspension.

In other terms, the invention consists, from the class of polyacrylamides, in using branched polyacrylamides in the dissolved powder form. This selection unexpectedly makes it possible, in the papermaking application for the retention of fillers and of fines, to achieve a level of performance previously unequalled. The use of branched polymers moreover makes it possible to better retain the bentonite on the sheet and, for this reason, to limit its negative effects on the subsequent water treatment. Additionally, the choice of this branched polyacrylamide increases the fixing power of the bentonite on the sheet, thereby resulting in a synergy and thus a recoagulation which reduces the content of bentonite in the white waters.

Advantageously, the branched polyacrylamide is in practice a cationic copolymer of acrylamide and of an unsaturated cationic ethylenic monomer, chosen from the group comprising quaternised or salified dimethylaminoethyl acrylate (DMAEA) or dimethylaminoethyl methacrylate (DMAEMA), dimethyldiallylammonium chloride (DAD-MAC), acrylamidopropyltrimethylammonium chloride (APTAC) and methacrylamidopropyltrimethylammonium chloride (MAP-TAC). In a known way, this copolymer is branched by a branching agent consisting of a polyfunctional compound having at least two reactive groups chosen from the group comprising double bonds, aldehyde bonds or epoxy bonds. These compounds are well known and are described, for example, in the document EP-A-0,374,458.

As is known, a branched polymer, denoted in the English language by the expression "branched", is a polymer which has, along the whole length of the chain, branches, groups or ramifications arranged overall in a plane and no longer in the three directions, as is a crosslinked polymer; such high molecular weight branched polymers, easily soluble in water, are well known as flocculating agents. These branched polyacrylamides are distinguished from crosslinked polyacrylamides (frequently denoted by the English expression "crosslinked") by the fact that, in the latter, the groups are arranged in three dimensions to give products which are virtually insoluble and of infinite molecular weight.

In practice, the branching agent is methylenebisacrylamide (MBA), introduced at a concentration of five to two hundred (5 to 200) mol per million mol of monomers.

Advantageously, the amount of branched polyacrylamide introduced is between thirty and a thousand grams/tonne (30 and 1000 g/t) of dry pulp; it was observed that if the amount is less than 0.03%, no significant retention is obtained; likewise, if this amount exceeds 0.1%, no proportional improvement is observed; however, in contrast to the linear cationic polyacrylamides, as described in the documents EP-A-0,017,353 and 235,893 targeted in the preamble, no reverse dispersion effect by recirculation in the closed circuits of the polymer excess not retained on the sheet is observed. Preferably, the amount of branched polyacrylamide introduced is between 0.05 and 0.5 per thousand (%) of the amount of dry pulp.

As already said, it is important that the branched polymer is used in the form of a diluted powder; in effect, if a branched polymer as an emulsion is resorted to, the necessary presence in these emulsions of surface-active agents promotes the formation of foams during the manufacture of the paper and the appearance of disparities in the physical properties of the finished paper (modification of the absorbence at places where part of the oil phase of the emulsion is retained on the sheet).

Bentonite, also called "swelling smectic clay", of the montmorillonite family, is well known and there is no need to describe it here in detail; these compounds, formed from microcrystallites, contain, at the surface, sites having a high cation exchange capacity capable of retaining water (see, for example, document U.S. Pat. No. 4,305,781 and FR-A-2,283,102). A semi-sodium bentonite is preferably used, which is introduced just upstream of the head box, at a concentration of 0.1 to 0.5 percent (0.1 to 0.5%) of the dry weight of the fibrous suspension.

In an advantageous embodiment, the branched polyacrylamide powder is first of all dissolved in water, this solution is then introduced into the pulp tower of the circuit of the fibrous suspension, at a concentration of 0.05 to 0.5 per thousand (0.05 to 0.5%) by dry weight of the dry weight of this fibrous suspension, the mixture is then stirred and sheared and, finally, bentonite, at a concentration of 0.1 to 0.5 percent (0.1 to 0.5%) of the dry weight of the fibrous suspension is added, while still stirring, upstream of the headbox. The branched polymer, dissolved beforehand at a concentration of 0.1 to 3 g/liter, is introduced before the pump for supplying the pulp into the pulp circuit, preferably into the pulp tower, and the bentonite is introduced just upstream of the head box.

The way in which the invention may be carried out and the advantages which follow therefrom will emerge better from the implementation examples which follow.

DETAILED DESCRIPTION OF THE INVENTION

Preparation of a weakly cationic branched polyacrylamide

The following are mixed in a reactor at room temperature:

- 13,240 kilograms of acrylamide at 30% in water;
- 1,600 kilograms of a quaternary ammonium salt derived from methyl chloride and dimethylaminoethyl acrylate (DMAEA) at 75% in solution in water;
- 50 kilograms of water and 100 kilos of adipic acid;
- and 0.129 kilogram of methylenebisacrylamide (MBA) (i.e. 25 ppm with respect to the active material) as branching agent.

A solution is obtained, the pH of which is 3.6, to which there is added, while still stirring, one thousand (1,000) ppm of catalyst: isobutyronitrile (AZDN) (i.e. 15 kilograms).

The solution is cooled to 0° C. and is degassed by bubbling with nitrogen. A transfer agent (mercaptoethanol) is then added at a concentration of ten (10) ppm with respect to the filler (i.e. 0.15 kilogram) as a reaction limiter.

4.2 ppm of ammonium persulphate (63 grams) and 0.86 ppm of iron in the form of Mohr salt (6 ppm of Mohr salt, i.e. 90 grams) are then added. The exothermic reaction is allowed to continue for approximately one hour, until a temperature of 92° C. is reached.

A gel is then obtained which is allowed to age for two hours, and which is then ground, dried in hot air and reground again until a particle size of less than one millimeter is obtained.

A white power is then obtained which is perfectly soluble up to forty grams per liter (40 g/l) at room temperature and which has an insolubles level of less than 0.02 percent (0.02%). This branched polyacrylamide powder has a Brookfield viscosity in the region of 2.6 cps (UL, at 0.1% in a 1M NaCl solution at 25° C. at sixty revolutions per minute (60 rev/min)).

This polymer has a cationicity of ten (10) mol percent and a cationicity, measured by the colloidal method, of less than the theoretical cationicity. However, after shearing, this cationicity increases, which well attests to the branched and nonlinear nature of this polymer. Finally, this polymer exhibits a cationicity recovery after shearing of the order of 20%.

As this polymer is highly soluble in water (insoluble $<0.01\%$), it is therefore not crosslinked.

EXAMPLE 1

A paper pulp comprising 80% of actual pulp at a concentration of thirty five percent (35%) bleached hardwood, ten percent (10%) coated broke and thirty five percent (35%) bleached kraft, and twenty percent (20%) of calcium carbonate is prepared in a known way.

In a neutral medium, the sizing is carried out with 2.0% of alkylketene dimer.

The fibrous suspension is dissolved in water at a concentration of 2.5 grams/liter. The pH of this suspension is 7.5.

650 $cm^3$ of this fibrous suspension are introduced into the bowl of a CTP (trade-mark of CENTRE TECHNIQUE DU PAPIER CARTONS ET CELLULOSES) automatic former. 200 grams/tonne (0.2%) of the weakly cationic branched polyacrylamide prepared previously are then added. The mixture is stirred for thirty seconds.

1400 grams/tonne (0.14%) of bentonite, of the type marketed by the Applicant under the name CP-B1, having a density of 900 kilos/cubic meter, a swelling power of 40 ml/2 g, a cation exchange capacity of 85 meq/100 g while dry, and a mean size of less than 75 microns, are then added. The mixture is stirred again for thirty seconds and then drained by vacuum.

The turbidity in the white waters is then measured by weighing the solids as well as the weight of the dry sheet formed. The mass balance makes it possible to establish the retention figure according to the formula:

$$\frac{\text{Weight of the sheet}}{\text{Weight of the sheet + dry weight in the white waters}} \times 100$$

A retention of 89.5% is obtained in this way.

In the same way as above, retention tests are repeated at variable doses of the weakly cationic branched polymer prepared beforehand according to the process described above. The results are summarised in Table 1 below.

TABLE 1

| % polymer | % retention |
|---|---|
| 0.03 | 75 |
| 0.05 | 80 |
| 0.2 | 89.5 |
| 0.3 | 92 |
| 0.4 | 92 |
| 0.5 | 92.1 |
| 0.75 | 96.1 |

An improvement in retention is observed which is directly linked to the proportion of polymer. Polymer excesses do not give reverse effects.

EXAMPLE 2

Example 1 is repeated, the branched polyacrylamide being replaced by a linear cationic polyacrylamide of the type described in the document FR-B-2,390,983, marketed by the Applicant under the name FO 4190 PG, of UL viscosity 2.9 and commonly used for retention in papermaking. The following results are obtained:

| % FO 4190 PG | % retention |
|---|---|
| 0.2 | 70 |
| 0.5 | 78 |
| 0.75 | 75 |

It is observed that the retention obtained by means of the branched product (Example 1) is 18% greater than that obtained with a linear copolyacrylamide of the same cationic charge (Example 2).

Moreover, with an excess of cationic linear polymer, a reverse effect is quickly observed.

EXAMPLE 3

By repeating the teachings of the document EP-A-0,202,780, a crosslinked emulsion is prepared containing ten mol percent of chloromethylated DMAEA with 10 ppm of MBA but without limiter, having a UL viscosity of 2.75.

This polyacrylamide is entirely crosslinked and thus has very little solubility.

At an equal active material level, this emulsion is used as in Example 2 at a 0.2% proportion.

A degree of retention of 40% is then obtained.

EXAMPLE 4

The same emulsion is used as in Example 3. It is put into water and is then sheared by an Ultraturrax mixer, marketed by the company Ika (Germany), rotating at ten thousand revolutions per minute. After thirty minutes, a maximum cationicity recovery of 35% is then obtained.

At the same proportion, the retention in the region of 75% is obtained.

In the document EP-A-0,202,780, it is explained that crosslinked products such as in Example 3 need to be sheared to obtain an optimum effectiveness. This is confirmed by the tests of Examples 3 and 4. However, the crosslinked and then sheared product has a much lower effectiveness than a branched copolymer of the same composition and of the same cationicity.

Preparation of a moderately cationic branched polyacrylamide

The following are mixed in a reactor at room temperature:

7,848 kilograms of acrylamide at 30% in water;

7,000 kilograms of a quaternary ammonium salt derived from methyl chloride and dimethylaminoethyl acrylate (DMAEA) at 75% in solution in water;

152 kilograms of adipic acid;

and 0.380 kilogram of methylenebisacrylamide (MBA) (i.e. 50 ppm with respect to the active material) as branching agent.

A solution is obtained, the pH of which is 3.6, to which is added, while still stirring, one thousand (1,000) ppm of catalyst: isobutyronitrile (AZDN) (i.e. 15 kilograms).

The solution is cooled to 0° C. and is degassed by bubbling with nitrogen. A transfer agent (mercaptoethanol) is then added at a concentration of fifty (50) ppm with respect to the filler (i.e. 0.75 kilogram) as reaction limiter.

4.2 ppm of ammonium persulphate (63 grams) and 0.86 ppm of iron in the form of Mohr salt (6 ppm of Mohr salt, i.e. 90 grams) are then added. The exothermic reaction is then allowed to continue for approximately one hour until a temperature of 92° C. is reached.

A gel is then obtained which is allowed to age for two hours, and which is then ground, dried in hot air and reground again, until a particle size of less than one millimeter is obtained.

A white powder is then obtained which is perfectly soluble up to forty five grams per liter (45 g/l) at room temperature and which has a level of insolubility of less than 0.02 percent (0.02%). This branched polyacrylamide powder has a Brookfield viscosity of 1.8 (UL, at 0.1% in a 1M NaCl solution at 25° C. at sixty revolutions per minute (60 rev/min)).

This polymer has a cationicity of forty five (45) mol percent and a cationicity, measured by the colloidal method, of less than the theoretical cationicity. However, after shearing, this cationicity increases, which well attests to the branched and nonlinear nature of this polymer. Finally, this polymer exhibits a cationicity recovery after shearing of the order of 23%.

As this branched polymer is highly soluble in water (% insoluble $<$0.02%), it is therefore not crosslinked.

EXAMPLE 5

A paper pulp comprising thirty percent (30%) of recovered paper, thirty percent (30%) of bleached kraft, twenty percent (20%) of calcium carbonate, ten percent (10%) of coated broke and ten percent (10%) of bleached hardwood is prepared in a known way.

This fibrous suspension is dissolved in water at a concentration of 2.5 grams/liter. The pH of this suspension is 7.6.

The retention tests are carried out in the same way as in Example 1 with the moderately cationic branched polymer above, and then for comparison with a linear polyacrylamide of the same cationicity, with a UL viscosity of 2.2, marketed by the Applicant under the name FO 4550 BPM.

The results are shown in Table No. 2.

TABLE 2

| FO 4550 BPM % retention | MCBP % retention | Proportion % polymer |
|---|---|---|
| 64 | 78 | 0.03 |

TABLE 2-continued

| FO 4550 BPM % retention | MCBP % retention | Proportion % polymer |
|---|---|---|
| 72 | 89 | 0.05 |
| 80 | 93 | 0.2 |
| 82 | 95.5 | 0.3 |
| 80 | 95.3 | 0.5 |
| 79 | 96.4 | 0.7 |

A marked advantage of the moderately cationic branched polymer with respect to a linear copolyacrylamide of the same cationic charge is observed. The branched produced sees its effect set off much more rapidly and makes it possible for very high retention figures to be reached.

EXAMPLE 6

The retention of kaolin in slightly acidic medium was studied. The fibrous composition is 40% beaten bleached kraft and 60% bleached hardwood. 20% of filler with respect to the fibres is introduced. The sizing is carried out with a rosin reinforced to the levels of 1.3 percent in dryness; pH adjusted to 5 with aluminium sulphate.

Comparative retention tests were carried out on this suspension with the branched polyacrylamide powder used in Example 1 in accordance with the invention, the linear polymer powder of the prior art used in Example 2 (FO 4190 PG) and the sheared polymer emulsion, also of the prior art, used in Example 4.

The following results are obtained:

| Polymers used | % dry polymer with respect to the dry paper | total retention % |
|---|---|---|
| Linear powder | 0.2 | 78 |
| FO 4190 PG | 0.5 | 87 |
| Branched powder | 0.2 | 92 |
| Example 1 | 0.5 | 96.5 |
| Sheared crosslinked emulsion | 0.2 | 78 |
| Example 4 | 0.5 | 82 |

EXAMPLE 7

In the same way as described beforehand, a range of moderately cationic polymers (45 mol %) having different degrees of branching is prepared as described in Table 3 below.

TABLE 3

| Polymer | MBA mol/million mol | UL viscosity cps |
|---|---|---|
| A | 25 | 1.7 |
| B | 50 | 1.8 |
| C | 75 | 2.1 |
| D | 100 | 2.2 |

With these polymers, retention tests are carried out on the fibrous suspension as described in Example 5.

The results obtained are the following:

| Product | degree of insoluble % | % of polymer dry paper | total retention % |
|---|---|---|---|
| A | <0.01 | 0.2 | 81 |
| B | <0.01 | 0.2 | 93 |
| C | <0.01 | 0.2 | 97 |
| D | <0.01 | 0.2 | 97 |

These results show that the retention effect increases as the branching increases.

The process according to the invention, which consists in having chosen, from the polyacrylamides, branched polyacrylamides in the powder form in combination with bentonite, makes it possible not only to unexpectedly improve the degree of retention with respect to other polyacrylamides, and thus the effectiveness of the treatment, but also makes it possible to improve the clearness of the backwaters, without reverse effect. Additionally, it also makes it possible to treat, with success, pulps containing fillers.

With respect to the bentonite and linear polyacrylamide powder combination, an improvement in the degree of retention of the order of ten to twenty percent (10 to 20%) is thus observed, which results in a consequent reduction in pollution and allows better recirculation of the fines and the fillers in the machine circuit and better operation of these machines. Additionally, fewer bacterial deposits are observed in the circuit and thus fewer flaws, fewer breaks and fewer holes in the paper.

With respect to the mixtures of bentonite and of polyacrylamide emulsions, fewer rejections of oil or of surface-active agents are observed, which rejections, as already stated, affect the properties of the finished paper.

Finally, with respect to other polyacrylamide powders, the use of branched polyacrylamides allows high dissolution rates, avoids overflocculation, and thus the absence of flocking on the paper, and, as already stated, the absence of reverse effect in the case of overcharging.

We claim:

1. An improved process for manufacturing paper or cardboard having improved retention, consisting of adding a polyacrylamide as the sole flocculent and a bentonite to a fibrous suspension of pulp, the steps comprising:

dissolving in water a branched cationic polyacrylamide powder having a cationcity from about 10 to 45 mol percent; wherein said branched polyacrylamide is a cationic copolymer of acrylamide and of an unsaturated cationic ethylenic monomer, chosen from the group consisting of quaternised dimethylaminoethyl acrylate (DMAEA), salified dimethylaminoethyl acrylate (DMAEA), quaternised dimethylaminoethyl methacrylate (DMAEMA), salified dimethylaminoethyl methacrylate (DMAEMA), dimethyldiallyl-ammonium chloride (DADMAC), acrylamidopropyltrimethylammonium chloride (APTAC), and methacrylamido-propyltrimethylammonium (MAPTAC); and wherein said polyacrylamide is branched by a branching agent consisting of a polyfunctional compound having at least two reactive groups chosen from the group consisting of double bonds, aldehyde bonds, and epoxy bonds, introducing said dissolved branched cationic polyacrylamide into the fibrous suspension at a concentration of 0.03 to 1.0 per thousand (0.03 to 1.0%) by weight of dry weight of the fibrous suspension;

shearing the suspension containing said dissolved branched cationic polyacrylamide; and adding bentonite thereto at a concentration of 0.1 to 0.5 percent (0.1 to 0.5%) of dry weight of the fibrous suspension while stirring to form a resulting suspension.

2. The process according to claim 1 wherein said branching agent is methylenebisacrylamide (MBA) introduced at a concentration of five to two hundred (5 to 200) mol per million mol of monomers.

3. The process according to claim 1 wherein said bentonite is a semi-sodium bentonite.

4. The process according to claim 1 wherein the dissolved branched polyacrylamide solution is introduced into a pulp tower of a pulp circuit at a concentration of 0.05 to 0.5% dry weight to dry weight of the fibrous suspension, producing a mixture which is stirred and sheared and said stirred and sheared solution is mixed with 0.1 to 0.5 percent (0.1 to 0.5%) bentonite, with stirring, upstream of a head box.

* * * * *

UNITED STATES PATENT AND TRADEMARK OFFICE

CERTIFICATE OF CORRECTION

PATENT NO. : 5,393,381

DATED : February 28, 1995

INVENTOR(S) : HUND, et al.

It is certified that error appears in the above—identified patent and that said Letters Patent is hereby corrected as shown below:

In Claim 1, Column 8, Line 67 of the Patent, change "1.0%" to --0.1%--.

Signed and Sealed this

Twenty-sixth Day of September, 1995

*Attest:*

*Attesting Officer*

BRUCE LEHMAN

*Commissioner of Patents and Trademarks*